US006584206B2

(12) United States Patent
Ohashi

(10) Patent No.: US 6,584,206 B2
(45) Date of Patent: Jun. 24, 2003

(54) SPEAKER APPARATUS

(75) Inventor: Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/000,140

(22) Filed: Oct. 19, 2001

(65) Prior Publication Data

US 2002/0114478 A1 Aug. 22, 2002

(30) Foreign Application Priority Data

Oct. 25, 2000 (JP) ..... 2000-325212

(51) Int. Cl.[7] ..... H04R 25/00

(52) U.S. Cl. ..... 381/191; 381/174; 381/402

(58) Field of Search ..... 381/174, 191, 381/402, 408, 113, 116

(56) References Cited

U.S. PATENT DOCUMENTS 3,008,013 A * 11/1961 Williamson et al. ..... 381/191
3,135,838 A * 6/1964 Wright ..... 381/191
3,892,927 A * 7/1975 Lindenberg ..... 381/191

* cited by examiner

*Primary Examiner*—Huyen Le
(74) *Attorney, Agent, or Firm*—Jay H. Maioli

(57) ABSTRACT

A fixed electrode is divided into a plurality of electrode pieces and driving signals of different voltages are applied to the electrode pieces such that a distribution of driving forces applied to a vibrator is proportional to the surface displacement distribution in a vibration mode across the vibrator.

3 Claims, 12 Drawing Sheets

MODE (m,n) = (1,1)

MODE (m,n) = (3,1)

MODE (m,n) = (1,3)

MODE (m,n) = (3,3)

SPEAKER APPARATUS

BACKGROUND OF THE INVENTION

1. Field of the Invention

The present invention generally relates to a speaker apparatus, and more particularly to an electrostatic speaker apparatus in which desired frequency versus sound pressure and vibration amplitude characteristics can be achieved.

2. Description of the Related Art

As known in the art, a so-called electrostatic (capacitor-type) speaker includes a pair of fixed electrodes that face each other, and a vibrator disposed between the pair of fixed electrodes. Such an electrostatic speaker is designed so that a driving signal is applied across the pair of fixed electrodes and a d.c. bias voltage is applied between an electrode of the vibrator and each of the fixed electrodes, thereby generating sound pressure according to the driving signal.

FIGS. 8 to 10 illustrate the structure of a conventional electrostatic speaker 1, by way of example. The electrostatic speaker (hereinafter referred to as "speaker apparatus") 1 includes frames 1*a* and 1*b* which are screwed to each other. Inside the frames 1*a* and 1*b,* fixed electrodes 2*a* and 2*b* are placed so as to face each other.

The fixed electrodes 2*a* and 2*b* are exposed to the air at openings 3*a* and 3*b* formed in the center of the frames 1*a* and 1*b,* respectively. As shown in FIG. 8, the fixed electrodes 2*a* and 2*b* are made of a substantially rectangular planar plate, and have multiple openings formed therein.

In the following description with respect to the structure, generally, the fixed electrodes 2*a* and 2*b* and a diaphragm 4 formed therebetween are rectangular; however, the fixed electrodes 2*a* and 2*b* and the diaphragm 4 may have a circular or any other shape.

The diaphragm 4 is placed in a gap between the fixed electrodes 2*a* and 2*b*. The outer periphery of the diaphragm 4 is held between a metal frame 5 and a vibrator electrode 6, and is fixedly received in the frames 1*a* and 1*b* through elastic members 7.

The diaphragm 4 has air gaps each having a predetermined length formed with respect to the fixed electrodes 2*a* and 2*b*. Specifically, as shown in FIG. 10, spacers 8*a* and 8*b* are disposed in close proximity to the fixed electrodes 2*a* and 2*b,* respectively, so that the diaphragm 4 is held between the spacers 8*a* and 8*b*. In this structure, the thickness of the spacers 8*a* and 8*b* can be used to precisely set the lengths of the air gaps, namely, a distance da from the fixed electrode 2*a* to the diaphragm 4 and a distance db from the fixed electrode 2*b* to the diaphragm 4.

Driving signals and d.c. bias voltages are applied to the speaker apparatus 1 having the above-described structure using a circuit shown in FIG. 11.

The circuit includes a booster transformer T1 and a transformer T2. A commercial power supply is connected to the primary winding of the booster transformer T1. The secondary winding of the booster transformer T1 is connected to a multistage voltage doubling rectifier circuit including diodes D1 to D7 and capacitors C1 to C8. The output of the multistage voltage doubling rectifier circuit is connected to the center tap of the secondary winding of the transformer T2.

The secondary winding of the transformer T2 is connected to the fixed electrodes 2*a* and 2*b* through resistors R3 and R4, respectively. One end of the secondary winding of the booster transformer T2 is connected to the vibrator electrode 6, or the diaphragm 4, through a resistor R1 and a terminal TC, so that d.c. bias voltages are applied between the diaphragm 4 and the fixed electrode 2*a,* and between the diaphragm 4 and the fixed electrode 2*b*. The d.c. bias voltages can be, for example, as high as 2.5 KV.

From a power amplifier connected to the speaker apparatus, audio signals are supplied across terminals which are connected to the primary winding of the transformer T2. As the audio signals are passed to the primary winding of the transformer T2 via a resistor R2, they are boosted by the transformer T2 before appearing on the secondary winding as the driving signals. The driving signals are thus applied to the fixed electrodes 2*a* and 2*b* through terminals TF and TR, respectively.

In the thus constructed electrostatic speaker 1, driving forces F are expressed by the following general equation (1) of the Coulomb's law:

$$F = k \cdot \frac{q_1 \cdot q_2}{r^2} \tag{1}$$

where q1 and q2 denote the charges of the electrodes, r denotes the distance between the electrodes, and k is the constant of proportion. Accordingly, the electrostatic speaker 1 is driven by the driving forces F calculated by general equation (1).

In the speaker apparatus 1, the fixed electrodes 2*a* and 2*b* are substantially rectangular, and the electrode surfaces facing the diaphragm 4 are entirely parallel to the diaphragm 4. In other words, the distance from any portion of the electrode surfaces to the diaphragm 4 is da or db shown in FIG. 10. Therefore, the driving forces applied to the diaphragm 4 are uniform over the diaphragm surface.

Now, a case is considered where uniform driving forces F which are expressed by $F=F_0\sin(\omega t)$ are generated on the entire surface of the diaphragm 4 by the applied voltages. Then, the frequency characteristic of displacement distribution z across the diaphragm 4 is defined by the following equation (2):

$$z = \sum_{m,n} \frac{\int (F_0 \Xi_{m,n}) dV}{M(\omega_{m,n}^2 - \omega^2)} \Xi_{m,n} \sin(\omega t) \tag{2}$$

where (m, n) indicates the order of the unique vibration mode of the diaphragm 4, and Ξ denotes a reference function which indicates the displacement distribution in the unique vibration mode. Furthermore, V denotes the volume, M denotes the total weight of the diaphragm 4, and $\omega_{m,n}$ and ω denote the mnth-order resonance angular frequency and the angular frequency, respectively.

In the following description, the substantially rectangular diaphragm 4 has sides with lengths of a and b in the x- and y-axis directions, respectively, by way of example. The x-axis direction corresponds to the direction in which the longer sides extend, and the y-axis direction corresponds to the direction in which the shorter sides extend, as viewed from the surface direction of the diaphragm 4, as shown in FIG. 8. In this case, the displacement distribution in the unique vibration mode is given by the following equation (3):

$$\Xi_{m,n} = \sin\frac{m\pi}{a}x \cdot \sin\frac{n\pi}{b}y \tag{3}$$

When equation (3) is substituted into equation (2), the following equation (4) is derived with respect to the displacement distribution z across the diaphragm 4:

$$z = \sum_{\substack{m=1,3,5\ldots \\ n=1,3,5\ldots}} \frac{4F_0 mn\pi^2}{abM(\omega_{m,n}^2 - \omega^2)}\Xi_{m,n}\sin(\omega t) \tag{4}$$

FIGS. 7A to 7D show four resonance modes as portions of the vibration modes indicated by equation (4).

FIG. 7A shows a resonance mode where (m, n)=(1, 1) in equation (4), showing the state where the entire surface of the diaphragm 4 vibrates in the same direction at a particular frequency. In a resonance mode where (m, n)=(3, 1) at a higher frequency, as shown in FIG. 7B, a vibration is created in a ridge-trough-ridge fashion along the longer sides (in the x-axis direction).

FIG. 7C shows a resonance mode where (m, n)=(1, 3) in which a vibration is created in a ridge-trough-ridge fashion along the shorter sides (in the y-axis direction). FIG. 7D shows a resonance mode where (m, n)=(3, 3) in which a vibration is created in a composite ridge-trough fashion along the longer sides and the shorter sides.

Therefore, the diaphragm 4 has a characteristic that multiple resonance modes may be generated, and the frequency characteristic found by calculation is shown in FIG. 12. FIG. 12 shows portions that may be affected by resonance in the resonance modes where (m, n)=(1, 1), (3, 1), (5, 1), and (7, 1).

Since multiple resonance modes may be generated, there have been problems with the speaker apparatus 1 in which the entire electrode surfaces of the fixed electrodes 2*a* and 2*b* are parallel to the diaphragm 4.

As shown in FIG. 12, there are peaks and dips in the amplitude versus frequency characteristic in the diaphragm center of the diaphragm 4 so that the characteristic is not smoothed. Many resonance modes are generated in the used frequency domain, resulting in peaks and dips in the output sound pressure versus frequency characteristic. Particularly, a problem occurs in the frequency domains corresponding to the resonance modes in which vibrations occur in reverse phase, as shown in FIGS. 7B, 7C, and 7D, in that the sound pressure level is reduced, namely, desired frequency versus sound pressure and vibration amplitude characteristics are not achieved.

In a similar way, in a speaker apparatus including fixed electrodes and a diaphragm which are shaped into a circle having a radius of a, the displacement distribution in the unique vibration mode across the diaphragm is expressed by the following equation (5) in the cylindrical coordinate system:

$$\Xi_{m,n}=J_m(\beta_{m,n,r}).(A_{m,n,c}\cos m\theta+A_{m,n,s}\sin m\theta) \text{ for } m=0, 1, 2, \ldots, n=0, 1, 2, \tag{5}$$

where Jm denotes an m-th Bessel function, r denotes the radial coordinate, A denotes the constant, θ denotes the angular coordinate, and β is given by the following equation (6):

$$J_m(\beta_{m,n}a)=0 \tag{6}$$

FIG. 13 shows vibration modes if uniform driving forces are acted on the entire surface of a circular diaphragm by the applied voltages in a similar way to the case where a rectangular diaphragm is used. In FIG. 13, m=0. Also in this case, a problem occurs in that multiple resonance modes are generated so that desired frequency versus sound pressure and vibration amplitude characteristics cannot be achieved.

A present inventor discloses an electrostatic speaker in Japanese Unexamined Patent Application Publication No. 9-182190 in which the surface shape of fixed electrodes is set so that distances from portions of the fixed electrodes to the surface of a vibrator vary and the driving forces applied to the vibrator are proportional to the surface displacement distribution in the unique vibration mode of the vibrator, whereby only a particular resonance mode is generated. For example, the surface shape of the fixed electrodes is curved so that distances from portions of the fixed electrodes to the surface of the vibrator are different and the driving forces applied to the vibrator are proportional to the surface displacement distribution in the unique vibration mode of the vibrator.

However, the electrostatic speaker disclosed in the above publication requires that the fixed electrodes be precisely machined, leading to a problem of an increase in cost.

SUMMARY OF THE INVENTION

Accordingly, it is an object of the present invention to provide a speaker apparatus in which only a single resonance mode is generated to achieve desired frequency versus sound pressure and vibration amplitude characteristics.

To this end, according to the present invention, a speaker apparatus includes a fixed electrode divided into a plurality of pieces, and a vibrator, which face each other. Driving signals of different voltages are applied to the divided fixed electrode pieces, and bias voltages are applied between an electrode of the vibrator and the fixed electrode, thereby applying driving forces to the vibrator according to the driving signals.

This allows distribution of the driving forces across the vibrator to be proportional to the surface displacement distribution in the unique vibration mode of the vibrator. Furthermore, there is no need to precisely machine the fixed electrodes, thereby providing a simplified driving circuit.

DESCRIPTION OF THE PREFERRED EMBODIMENT

An electrostatic speaker apparatus (hereinafter referred to as "speaker apparatus") 10 according to an embodiment of the present invention will be described with reference to the accompanying drawings.

In the following description with respect to the structure, generally, the speaker apparatus 10 has rectangular fixed electrodes and a rectangular diaphragm; however, a speaker apparatus including fixed electrodes and a diaphragm which are shaped into a circular or any other shape may also be implemented.

Figure 3:
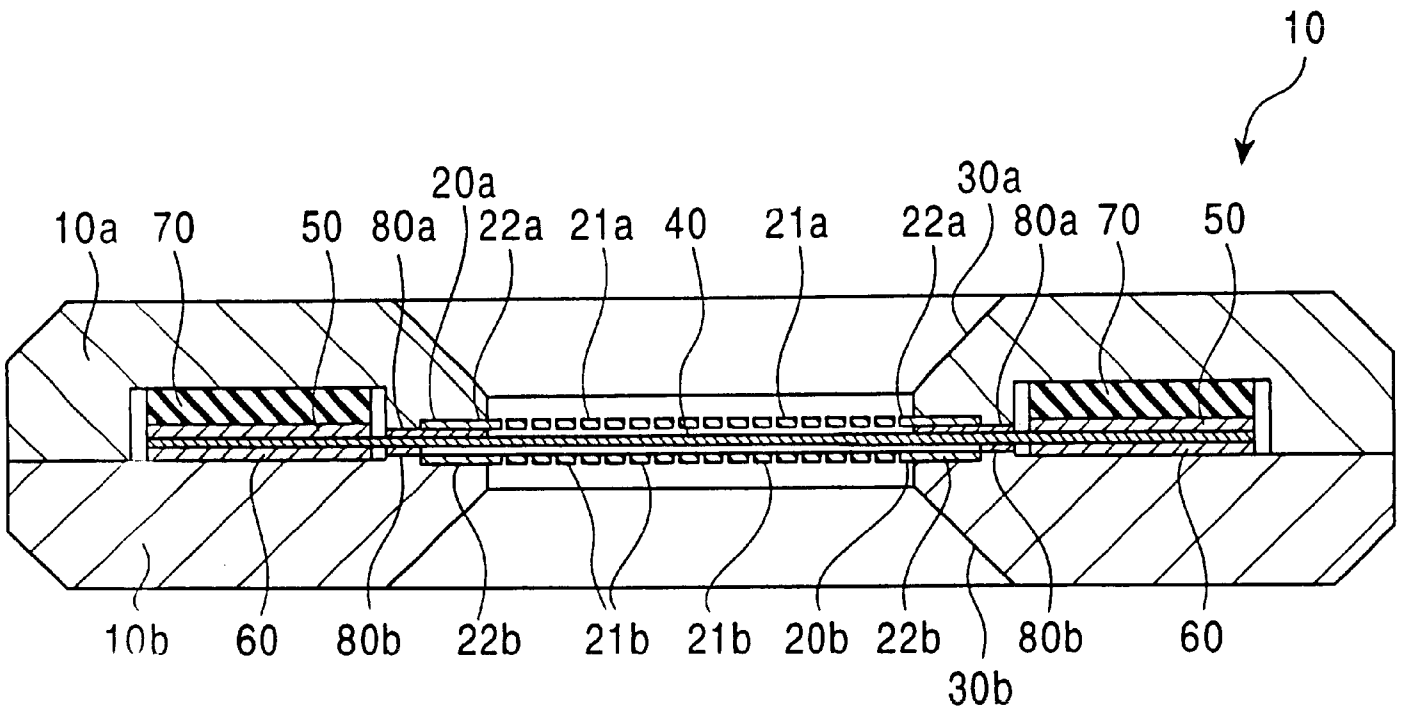
FIG. 3 is a vertically cross-sectional view of the overall speaker apparatus.
Figure 4:
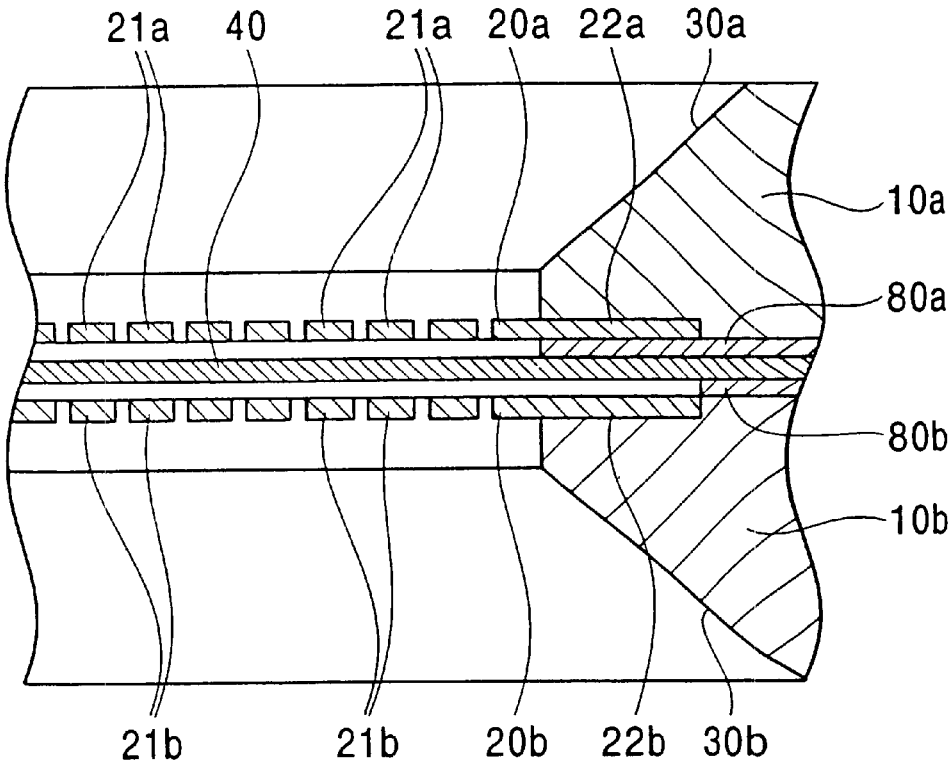
FIG. 4 is a cross-sectional view of an enlarged portion of the speaker apparatus shown in FIG. 3.

Referring to FIG. 3, the speaker apparatus 10 includes frames 10*a* and 10*b* which are screwed to each other. Inside the frames 10*a* and 10*b,* fixed electrodes 20*a* and 20*b* are placed so as to face each other, and the fixed electrode 20*a* includes a plurality of electrode pieces 21*a* and the fixed electrode 20*b* includes a plurality of electrodes pieces 21*b,* as described later. The electrode pieces 21*a* and 21*b* are divided at equal intervals from the fixed electrodes 20*a* and 20*b,* respectively, as shown in FIG. 4.

A diaphragm 40 serving as a vibrator which generates sound pressure is placed in a gap between the fixed electrodes 20*a* and 20*b.* The outer periphery of the diaphragm 40 is held between a metal frame 50 and a vibrator electrode 60, and is fixedly received in the frames 10*a* and 10*b* through elastic members 70.

The fixed electrodes 20*a* and 20*b* are exposed to the air at openings 30*a* and 30*b* formed in the center of the frames 10*a* and 10*b,* respectively. The fixed electrodes 20*a* and 20*b* are formed of the plurality of divided electrode pieces 21*a* and 21*b,* respectively, and include edge portions 22*a* and 22*b* having the diaphragm 40 held therebetween which are fixed between the frames 10*a* and 10*b* through spacers 80*a* and 80*b,* respectively.

As shown in FIG. 3, the fixed electrodes 20*a* and 20*b* are exposed to the air at the openings 30*a* and 30*b* which are formed in the center of the frames 10*a* and 10*b,* respectively, and have a large number of openings for guiding the sound pressure generated by vibration of the vibrator 40 to the outside.

Figure 5:
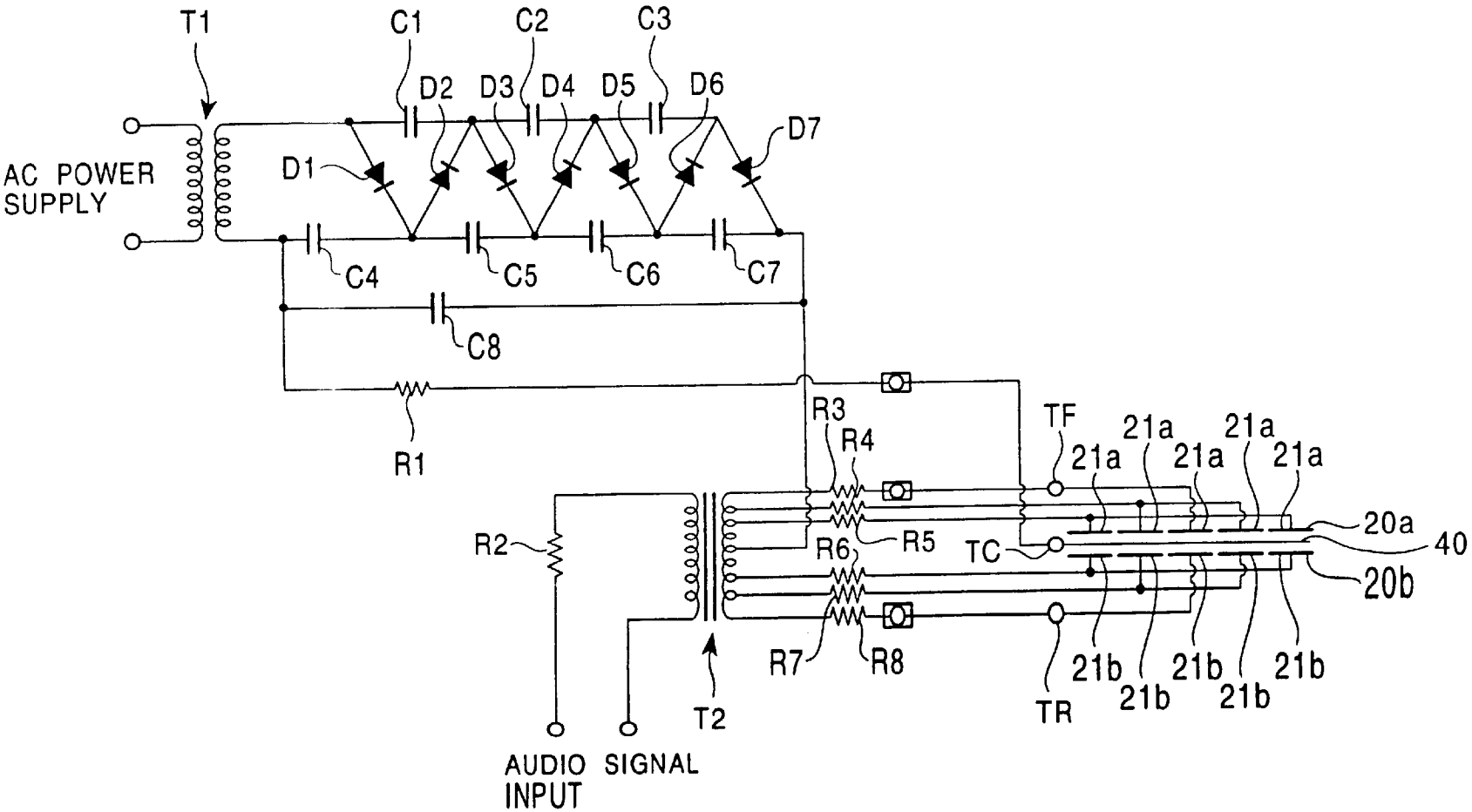
FIG. 5 is a circuit diagram of a driving circuit with respect to the speaker apparatus.

Driving signals and d.c. bias voltages are applied to the speaker apparatus 10 having the above-described structure using a circuit shown in FIG. 5.

The circuit includes a booster transformer T1 and a transformer T2. A commercial power supply is connected to the primary winding of the booster transformer T1. The secondary winding of the booster transformer T1 is connected to a multistage voltage doubling rectifier circuit including diodes D1 to D7, and capacitors Cl to C8. The output of the multistage voltage doubling rectifier circuit is connected to the center tap of the secondary winding of the transformer T2.

Although only a portion is schematically illustrated, a plurality of outputs are drawn from the both ends and intermediate portions of the transformer T2 by making use of the magnitude of voltage boosted due to the turns ratio of the secondary winding. These outputs are connected to the electrode pieces 21*a* and 21*b* of the fixed electrodes 20*a* and 20*b* via resistors R3, R4, R5, etc. One end of the secondary winding of the booster transformer T1 is connected to the vibrator electrode 60, or the diaphragm 40, through a resistor R1 and a terminal TC, so that d.c. bias voltages are applied between the diaphragm 40 and the fixed electrode 20*a,* and between the diaphragm 40 and the fixed electrode 20*b.* The d.c. bias voltages can be, for example, as high as 2.5 KV.

From a power amplifier connected to the speaker apparatus, audio signals are supplied across terminals connected to the primary winding of the transformer T2. As the audio signals are passed to the primary winding of the transformer T2 via a resistor R2, they are boosted by the transformer T2 before appearing on the secondary winding as the driving signals. The driving signals are then applied to the fixed electrodes 20*a* and 20*b* through terminals TF and TR, respectively.

In the thus constructed electrostatic speaker 10, driving forces F are expressed by the following general equation (7) of the Coulomb's law:

$$F = k \cdot \frac{q_1 \cdot q_2}{r^2} \tag{7}$$

where q1 and q2 denote the charges of the electrodes, r denotes the distance between the electrodes, and k is the constant of proportion. Accordingly, the electrostatic speaker 10 is driven by the driving forces F calculated by general equation (7).

In the speaker apparatus 10, the fixed electrodes 20*a* and 20*b* are substantially rectangular, and the electrode surfaces of the electrode pieces 21*a* and 21*b* facing the diaphragm 40 are entirely parallel to the diaphragm 40. In other words, a distance from any portion of the electrode surfaces to the diaphragm 40 is uniform.

Now, a case is considered where uniform driving forces F which are expressed by $F=F_0\sin(\omega t)$ are generated on the entire surface of the diaphragm 40 by the applied voltages. Then, the frequency characteristic of displacement distribution z across the diaphragm 40 is defined by the following equation (8):

$$z = \sum_{m,n} \frac{\int (F_0 \Xi_{m,n}) dV}{M(\omega_{m,n}^2 - \omega^2)} \Xi_{m,n} \sin(\omega t) \tag{8}$$

where (m, n) indicates the order of the unique vibration mode of the diaphragm 40, and Ξ denotes a reference function which indicates the displacement distribution in the unique vibration mode. Furthermore, V denotes the volume, M denotes the total weight of the diaphragm 40, and $\omega_{m,n}$ and ω denote the mnth-order resonance angular frequency and the angular frequency, respectively.

In the following description, the substantially rectangular diaphragm 40 has sides with lengths of a and b in the x-axis direction (longer sides) and in the y-axis direction (shorter sides), respectively, by way of example. In this case, the displacement distribution in the unique vibration mode is given by the following equation (9):

$$\Xi_{m,n} = \sin\frac{m\pi}{a}x \cdot \sin\frac{n\pi}{b}y \tag{9}$$

When equation (9) is substituted into equation (8), the following equation (10) is derived with respect to the displacement distribution z across the diaphragm 40:

$$z = \sum_{\substack{m=1,3,5\ldots \\ n=1,3,5\ldots}} \frac{4F_0 mn\pi^2}{abM(\omega_{m,n}^2 - \omega^2)} \Xi_{m,n} \sin(\omega t) \tag{10}$$

One feature of the present invention is that voltages applied to the electrode pieces 21*a* and 21*b* of the fixed electrodes 20*a* and 20*b* are weighted so that the driving forces applied to the diaphragm 40 may be proportional to the surface displacement distribution in the unique vibration mode of the diaphragm 40.

As used herein, the phrase "voltages are weighted" means that driving signals are applied at various voltages to the multiple electrode pieces 21*a* and 21*b* which are placed so as to face different portions of the diaphragm 40. For example, driving signals of voltages of 1 volt, 0.8 volt, and 0.6 volt are applied to the center electrode piece 21*a* or 21*b*, the electrode piece 21*a* or 21*b* adjacent thereto, and the further adjacent electrode piece 21*a* or 21*b*, respectively.

The present invention will be described in detail in conjunction with equations (7) to (10).

Weighting with respect to the electrode pieces 21*a* and 21*b* of the fixed electrodes 20*a* and 20*b* in the surface direction means that the driving forces applied to the diaphragm 40 are distributed, i.e., the driving forces on portions of the diaphragm 40 are different in part. Provided that distribution of the driving forces across the diaphragm 40 be proportional to the mode where (m, n)=(1, 1) as the unique vibration mode of the diaphragm 40, then, driving forces $F_0$ are given by the following equation (11):

$$F_0 = a\Xi_{1,1} \tag{11}$$

Equation (11) is substituted into equation (8). The linearity of the reference function allows the numerator in equation (8), namely, the term $\int(F_0\Xi_{m,n})dV$, to be developed by the following equation (12) unless m=1 and n=1:

$$\int(F_0\Xi_{m,n})dV = a\int(\Xi_{1,1}\Xi_{m,n})dV = 0 \tag{12}$$

By using equation (12), the following equation (13) which is expressed using only the terms m=1 and n=1 is derived from equation (10):

$$z = \frac{1}{\rho(\omega_{1,1}^2 - \omega^2)} \cdot \Xi_{1,1} \sin(\omega t) \tag{13}$$

Figure 7A:
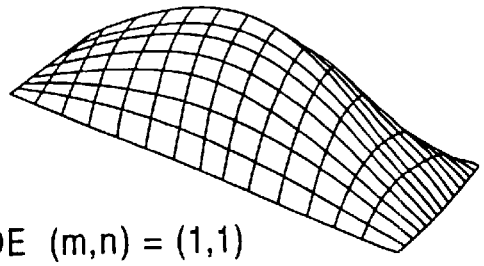
FIG. 7A (PRIOR ART)
FIGS. 7A to 7D are views of resonance modes of a rectangular vibrator incorporated in a conventional speaker apparatus.
Figure 7B:
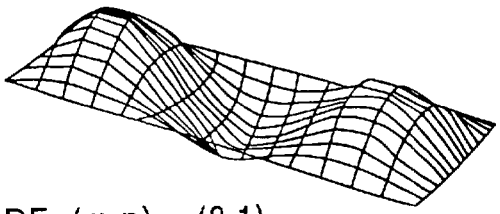
FIG. 7B (PRIOR ART)
Figure 7C:
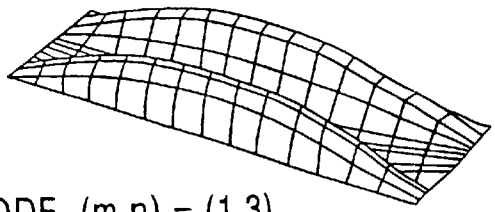
FIG. 7C (PRIOR ART)
Figure 7D:
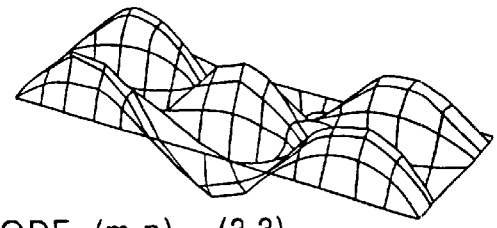
FIG. 7D (PRIOR ART)
Figure 8:
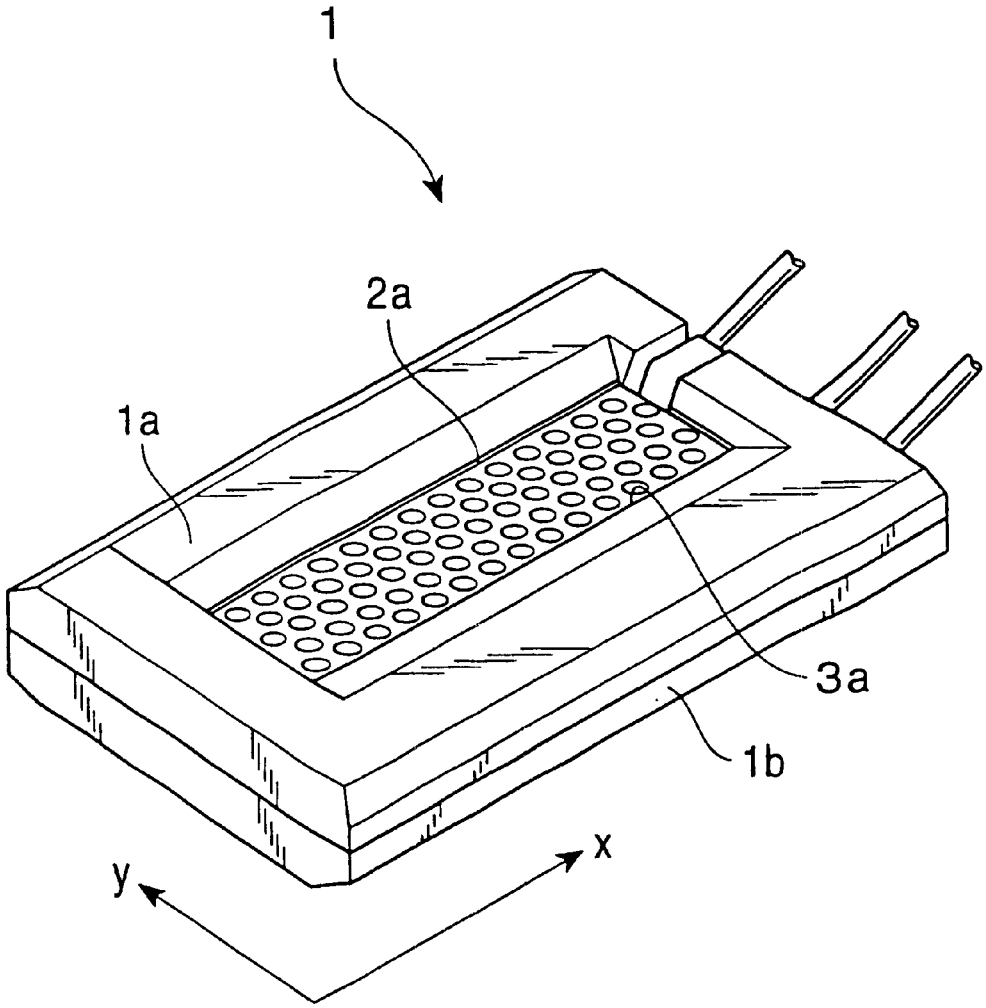
FIG. 8 (PRIOR ART)
FIG. 8 is a perspective view of an outer appearance of the conventional speaker apparatus.
Figure 9:
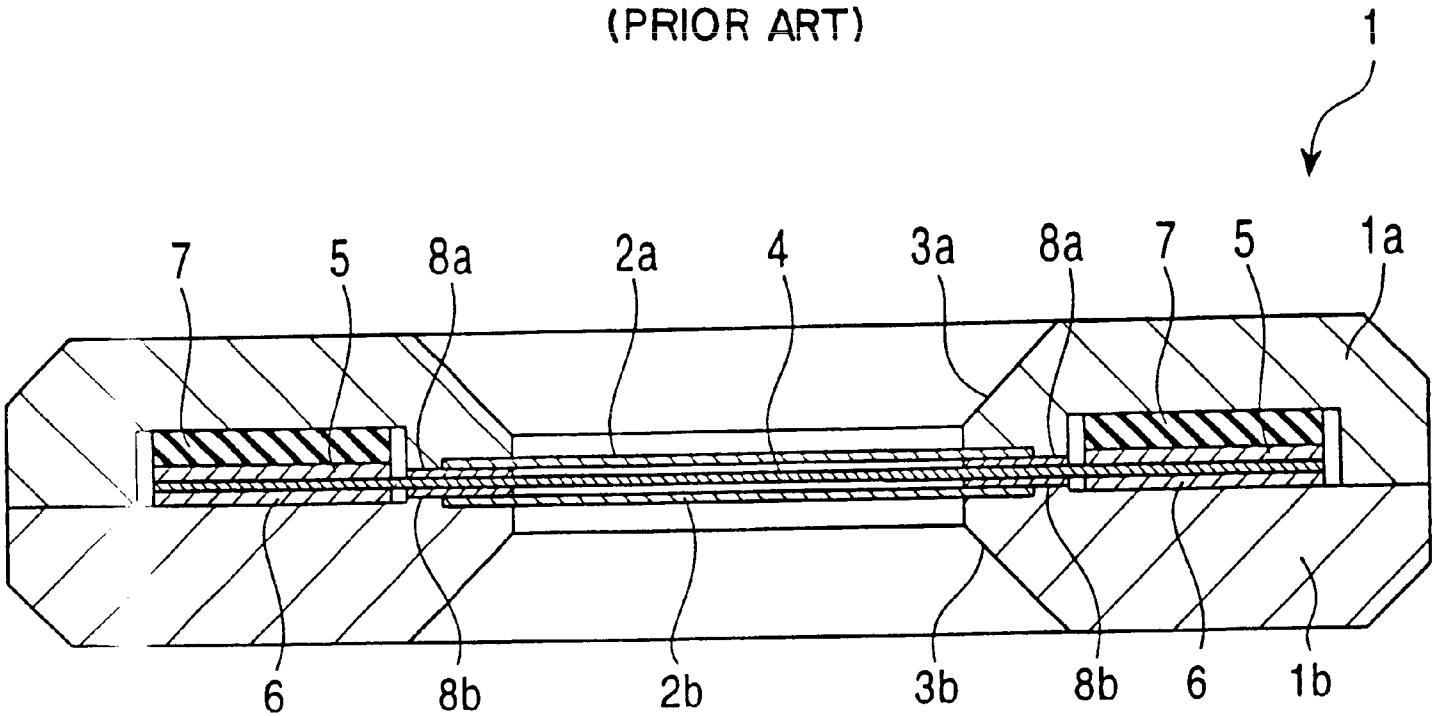
FIG. 9 (PRIOR ART)
FIG. 9 is a vertically cross-sectional view of the conventional speaker apparatus.
Figure 10:
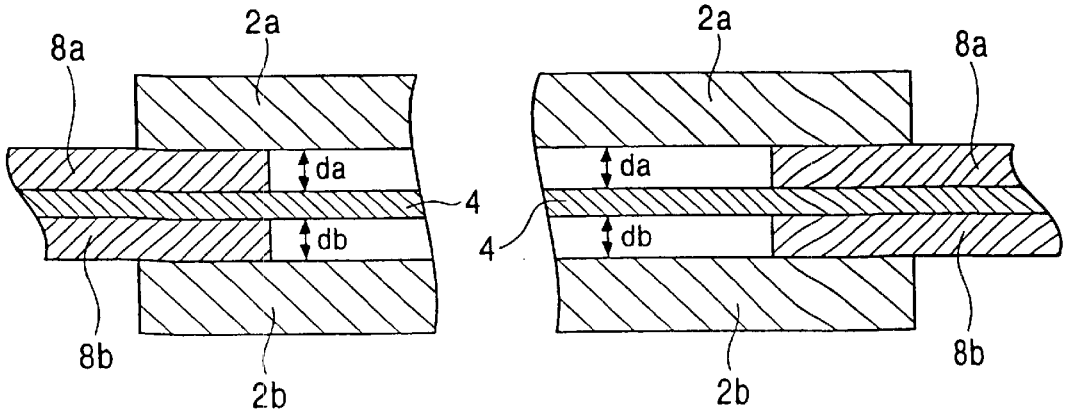
FIG. 10 (PRIOR ART)
FIG. 10 is a cross-sectional view of an enlarged portion of the speaker apparatus shown in FIG. 9.
Figure 11:
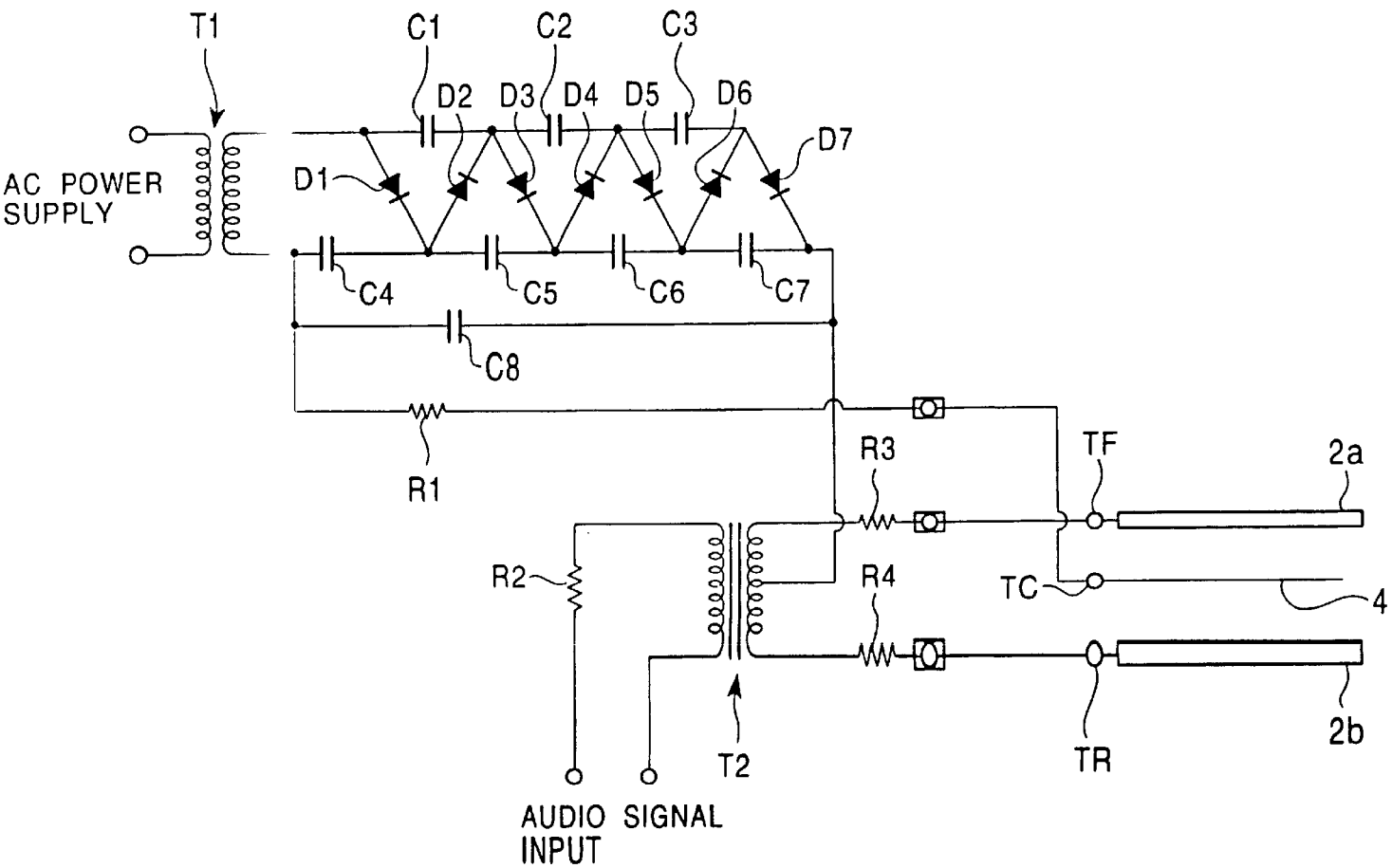
FIG. 11 (PRIOR ART)
FIG. 11 is a circuit diagram of a driving circuit with respect to the conventional speaker apparatus.
Figure 12:
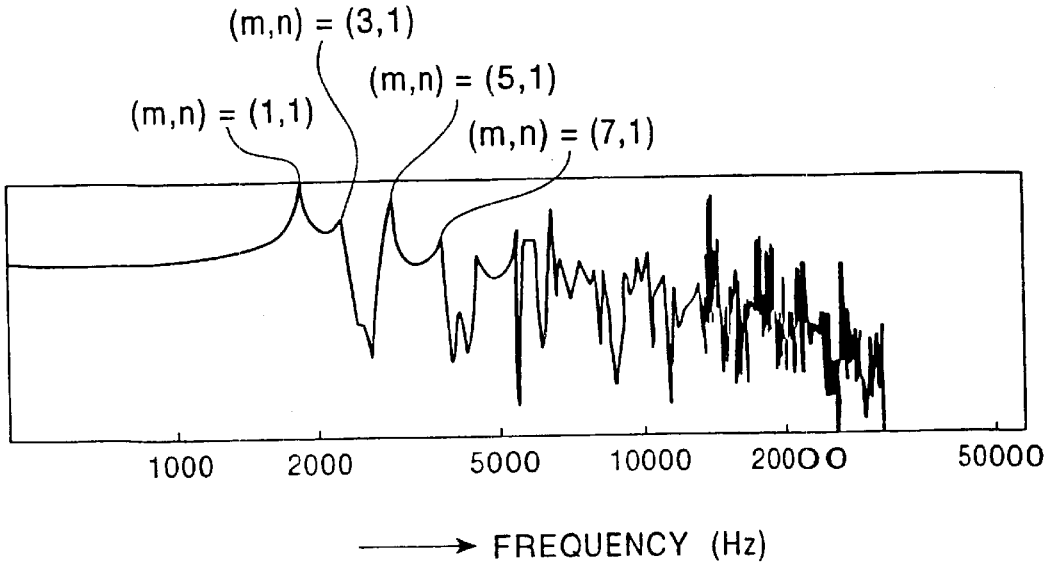
FIG. 12 (PRIOR ART)
FIG. 12 is a chart of the frequency characteristic of the conventional speaker apparatus.

It is obvious from equation (13) that resonance in the mode where (m, n)=(1, 1) only appears, as shown in FIG. 7A. That is, distribution of the driving forces $F_0$ across the diaphragm 40 is proportional to the unique resonance mode of the diaphragm 40, so that only one resonance mode can be generated.

Now, the principle in which a single resonance mode is generated in practice will be described based on the above-described principle.

The driving forces $F_0$ acted on the diaphragm 40 are calculated by the following equation (14):

$$F_0 = \frac{2^{\varepsilon 0} S V_{dc} V_{sg}}{d_0^2} \tag{14}$$

where ε0 denotes the permittivity of air, S denotes the area of the diaphragm 40, Vdc denotes the d.c. bias voltage, Vag denotes the signal voltage, and d0 denotes the distance from the diaphragm 40 to the fixed electrode 20*a* or 20*b*.

It is obvious from equation (14) that the driving forces $F_0$ are proportional to the signal voltages Vag applied to the fixed electrodes 20*a* and 20*b*. Accordingly, if the signal voltages which have been weighted are applied to the electrode pieces 21*a* and 21*b* of the fixed electrodes 20*a* and 20*b*, the driving forces can be optimally distributed across the diaphragm 40.

Therefore, the fixed electrodes 20*a* and 20*b* to which the weighted signal voltages are applied are divided into the electrode pieces 21*a* and 21*b*, and, as shown in FIGS. 3 and 4 in section, are shaped so that distribution of the driving forces acted on the diaphragm 40 may be proportional to the surface displacement distribution in the unique vibration mode of the diaphragm 40.

The signal voltages applied to the divided electrode pieces 21*a* and 21*b* are weighted by a method of making use of the magnitude of the voltage boosted due to the turns ratio of the coil from the secondary winding of the transformer T2, as shown in FIG. 5, and by a method (not shown) of inserting a resistor between each of the electrode pieces 21*a* and 21*b* and the transformer T2.

Figure 6:
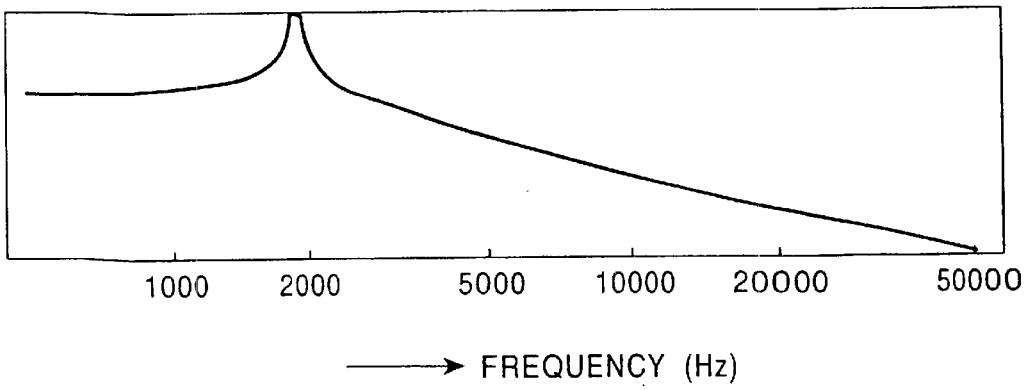
FIG. 6 is a chart of the frequency characteristic of the speaker apparatus.

As described above, in the speaker apparatus 10, resonance appears only in the mode (m, n)=(1, 1) with the frequency characteristic shown in FIG. 6. Therefore, the desired characteristics can be achieved in which there is no peak and dip in the frequency versus sound pressure and vibration amplitude characteristics.

The above-described embodiment is only illustrative, and a variety of changes and modifications may be made, if any, without departing from the spirit and scope of the invention. For example, the present invention may also be applicable to a speaker apparatus having multiple fixed electrodes or diaphragms which are layered, nested along the inner and outer peripheries, or arranged in a two-dimensional fashion.

Although a speaker apparatus using a rectangular diaphragm has been described and illustrated in the above-described embodiment, the shape of the diaphragm is not limited thereto, and a diaphragm having any shape may be used.

Figure 1:
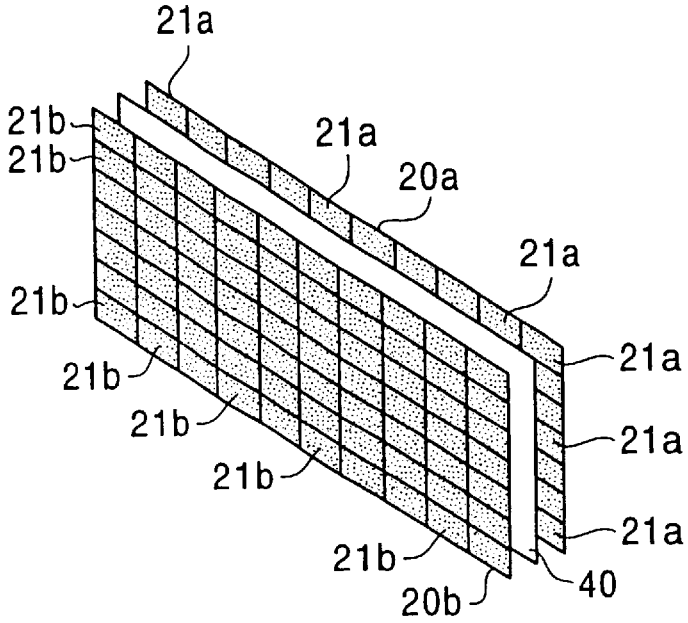
FIG. 1 is a perspective view of fixed electrodes and a vibrator incorporated in a speaker apparatus according to an embodiment of the present invention.
Figure 2:
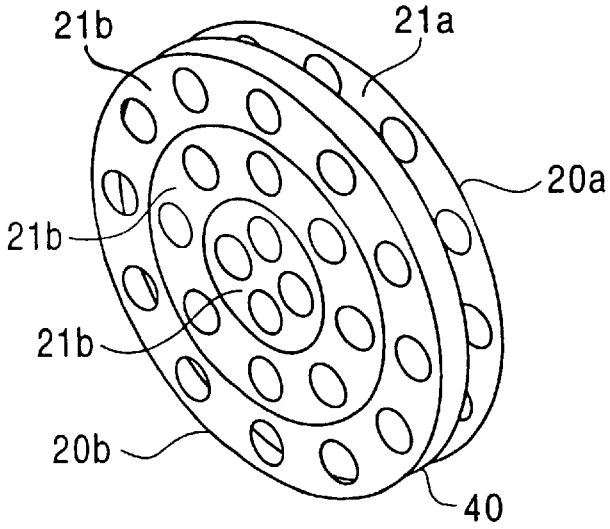
FIG. 2 is a perspective view of a modification of the fixed electrodes and the vibrator having another shape.
Figure 13:
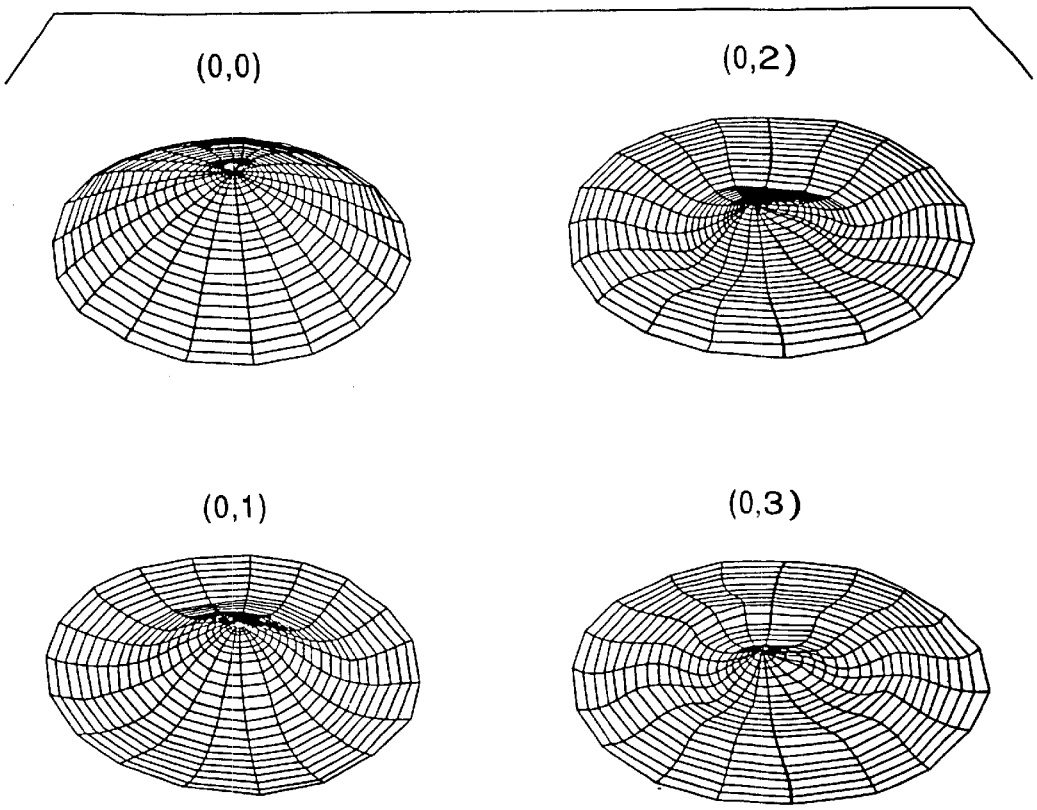
FIG. 13 (PRIOR ART)
FIG. 13 is a view showing resonance modes of a circular vibrator in the conventional art.

For example, as shown in FIG. 2, a circular fixed electrodes 20*a* and 20*b*, and circular diaphragm 40 may be used instead. In this case, as shown in FIG. 13, surface distribution in the unique vibration mode of the circular diaphragm 40 is proportional to the 0th-order Bessel function if m=0. Hence, desirably, the electrode pieces 21*a* and 21*b* of the fixed electrodes 20*a* and 20*b* are concentrically divided, and the signal voltage applied to each electrode (electrode piece) is weighted so that distribution of the driving forces acted on the diaphragm 40 may be proportional to the surface displacement distribution in the unique vibration mode of the diaphragm 40.

In summary, according to the present invention, whatever the shape of a diaphragm is, the unique vibration mode of that diaphragm is measured or analyzed, fixed electrodes are each divided into pieces having a shape such that the driving forces can be distributed according to the measurement or analysis, and the signal voltage applied to each electrode (electrode piece) is weighted.

Furthermore, although resonance appears only in the mode (m, n)=(1, 1) in the above-described embodiment, based on the same principle, it is also possible that resonance may appear only in another mode such as the mode (m, n)=(3, 1).

Furthermore, a speaker apparatus which is an electrostatic speaker having two fixed electrodes and a diaphragm sandwiched therebetween has been described in the above-described embodiment; however, the present invention may also be embodied as an electrostatic speaker using a single fixed electrode in order to drive a diaphragm from one side.

The specific shape and structure of the components described and illustrated in the above-described embodiment are only illustrative as a mode for carrying out the present invention, and it is not intended that the technical concept of the present invention be restrictively construed.

What is claimed is:

1. A speaker apparatus for generating sound pressure, comprising:

a pair of fixed electrodes;

a vibrator arranged between the pair of fixed electrodes and separated therefrom by a spacing; and means for producing a driving signal applied to the fixed electrodes and producing a bias voltage applied between an electrode of the vibrator and the pair of fixed electrodes to cause a driving force corresponding to the driving signal to be applied to the vibrator, wherein each of the pair of fixed electrode is divided into a plurality of electrode pieces, wherein said means for producing a driving signal includes a transformer having a plurality of secondary outputs producing a plurality of driving signals applied respectively to the plurality of electrode pieces, and wherein voltages of the plurality of driving signals applied to the plurality of electrode pieces are weighted so that driving forces applied to the vibrator are proportional to a surface displacement distribution in a unique vibration mode of the vibrator given by:

$$\Xi_{m,n} = \sin\frac{m\pi}{a}x \cdot \sin\frac{n\pi}{b}y$$

where m and n are integers indicating an order of the unique vibration mode of the vibrator, and where a and b are the lengths of the size of the vibrator in the x-axis direction and in the y-axis direction, respectively.

2. The speaker apparatus according to claim 1, wherein the fixed electrode and the vibrator are rectangular.

3. The speaker apparatus according to claim 1, wherein the fixed electrode and the vibrator are circular and a distribution of of the driving forces from a center to a periphery of the circular vibrator is proportional to a 0th-order Bessel function.

* * * * *